US008186970B2

(12) United States Patent
Cho

(10) Patent No.: US 8,186,970 B2
(45) Date of Patent: May 29, 2012

(54) SCROLL COMPRESSOR INCLUDING A FIXED SCROLL AND A ORBITING SCROLL

(75) Inventor: Yong-Il Cho, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 765 days.

(21) Appl. No.: 12/289,528

(22) Filed: Oct. 29, 2008

(65) Prior Publication Data

US 2009/0110570 A1 Apr. 30, 2009

(30) Foreign Application Priority Data

Oct. 30, 2007 (KR) ..... 10-2007-0109830

(51) Int. Cl.
*F04B 49/00* (2006.01)

(52) U.S. Cl. ..... 417/310; 417/307

(58) Field of Classification Search ..... 313/410.5; 417/410.5, 307, 310, 410.4, 902, 558, 559, 417/296, 301
See application file for complete search history.

(56) References Cited

U.S. PATENT DOCUMENTS

| | | | | |
|---|---|---|---|---|
| 4,846,633 | A * | 7/1989 | Suzuki et al. | 417/310 |
| 6,116,867 | A * | 9/2000 | Wallis et al. | 417/440 |
| 6,672,845 | B1 * | 1/2004 | Kim et al. | 417/310 |
| 6,984,114 | B2 * | 1/2006 | Zili et al. | 417/310 |
| 7,393,190 | B2 * | 7/2008 | Lee et al. | 418/55.1 |
| 7,972,125 | B2 * | 7/2011 | Stover et al. | 418/55.5 |
| 2002/0071773 | A1 * | 6/2002 | Matsuba et al. | 417/310 |
| 2003/0063983 | A1 * | 4/2003 | Ancel et al. | 417/310 |
| 2005/0019178 | A1 * | 1/2005 | Shin et al. | 417/410.5 |
| 2006/0140804 | A1 * | 6/2006 | Lee et al. | 418/55.2 |
| 2009/0297379 | A1 * | 12/2009 | Stover et al. | 418/55.1 |

FOREIGN PATENT DOCUMENTS

| | | |
|---|---|---|
| CN | 1576604 | 2/2005 |
| JP | 2006-207594 | 8/2006 |

* cited by examiner

*Primary Examiner* — Mariceli Santiago
*Assistant Examiner* — Glenn Zimmerman
(74) *Attorney, Agent, or Firm* — McKenna Long & Aldridge LLP

(57) ABSTRACT

The present invention relates to a scroll compressor. The scroll compressor is configured to have bypass holes communicated with compression chambers so as to bypass a part of a compressed refrigerant and thus to modulate a capacity of the compressor, a middle pressure chamber and a valve. Accordingly, it is capable of simplifying a capacity modulation apparatus of the scroll compressor, thereby miniaturizing the compressor and reducing a fabrication cost. And, as the bypass holes are disposed to be adjacent to each other, an operating capacity of the compressor can be easily modulated with only one bypass valve, accordingly it is capable of reducing the number of bypass valve and of enhancing reliability.

4 Claims, 10 Drawing Sheets

SCROLL COMPRESSOR INCLUDING A FIXED SCROLL AND A ORBITING SCROLL

RELATED APPLICATION

The present disclosure relates to subject matter contained in priority Korean Application No. 10-2007-0109830, filed on Oct. 30, 2007, which is herein expressly incorporated by reference in its entirety.

BACKGROUND OF THE INVENTION

1. Field of the Invention

The present invention relates to a capacity modulation apparatus of a scroll compressor.

2. Background of the Invention

Generally, a scroll compressor is broadly used in an air conditioning system and has characteristics of high efficiency and low noise. The scroll compressor is implemented in a manner as follows. That is, two scrolls relatively orbit and then one pair of compression chambers are formed between the two scrolls. And, as the compression chambers continuously move toward a center, volume thereof is reduced. Accordingly, a refrigerant is consecutively sucked, compressed and discharged.

In the related art scroll compressor, bypass holes are formed in the middle of the compression chambers and a part of a refrigerant implementing a middle pressure is moved toward a suction groove using the bypass holes so as to modulate a capacity of the compressor. Or, a discharge pipe and a suction pipe are connected to each other and a solenoid valve is installed therebetween so as to modulate the capacity of the compressor using a switching operation of the solenoid valve.

However, in the related art, the manner using the bypass holes has the following problems. That is, since the bypass holes are formed to be symmetric to each other centering a discharge outlet, a plurality of valves are required to switch the bypass holes. Accordingly, a fabrication cost may increase. And, since it is required to control the bypass holes disposed to be remote from each other at the same time, reliability may decrease. And, the manner using the discharge pipe and the suction pipe connected to each other also has the following problems. That is, since the pipes are intricately arranged and valves should be installed at the pipes, the compressor may be enlarged. And, since the number of assembly processes may increase, the fabrication cost may increase.

SUMMARY OF THE INVENTION

Therefore, an object of the present invention is to provide a scroll compressor which is capable of modulating a capacity of the compressor using bypass holes, of reducing the number of valves for controlling the modulation of the capacity, of enhancing reliability, of miniaturizing the compressor by simplifying pipes and of reducing a fabrication cost.

To achieve these and other advantages and in accordance with the purpose of the present invention, as embodied and broadly described herein, there is provided a scroll compressor comprising a hermetic container, a fixed scroll fixed in the hermetic container and provided with a spiral shaped fixed wrap and an orbiting scroll provided with a spiral shaped orbiting wrap engaged with the fixed wrap of the fixed scroll so as to implement one pair of compression chambers. At least one of the fixed scroll and the orbiting scroll is provided with one or more bypass holes communicated with the compression chambers. A chamber having a specific volume is formed at an outlet side of the bypass holes. And, a valve is installed at one side of the chamber so as to open/close an inner space of the chamber.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereafter, description will now be given in detail of one embodiment of a scroll compressor according to the present invention with accompanying drawings.

Figure 1:
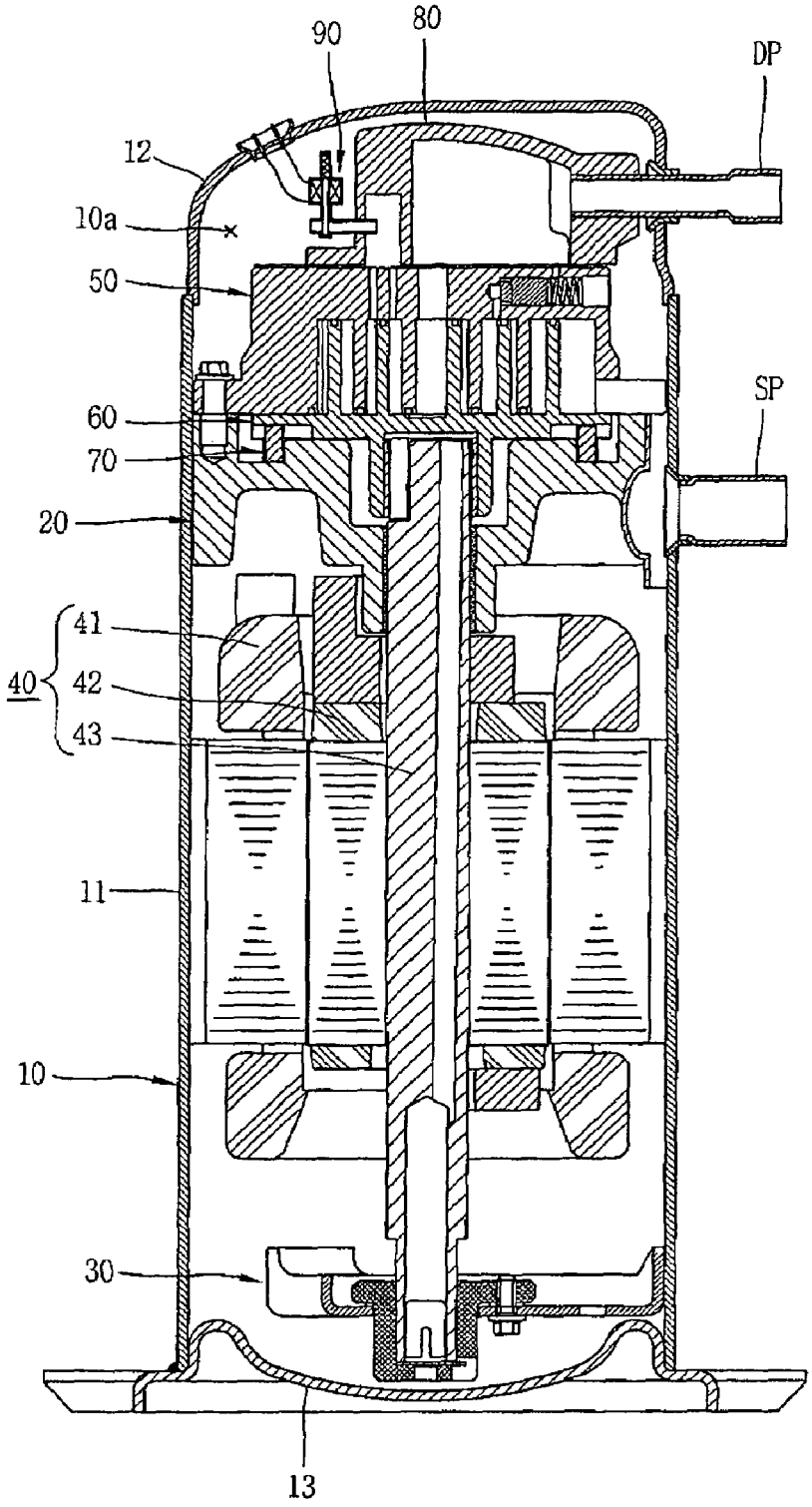
FIG. 1 is a cross section view showing one exemplary low pressure type scroll compressor in accordance with the present invention.
Figure 2:
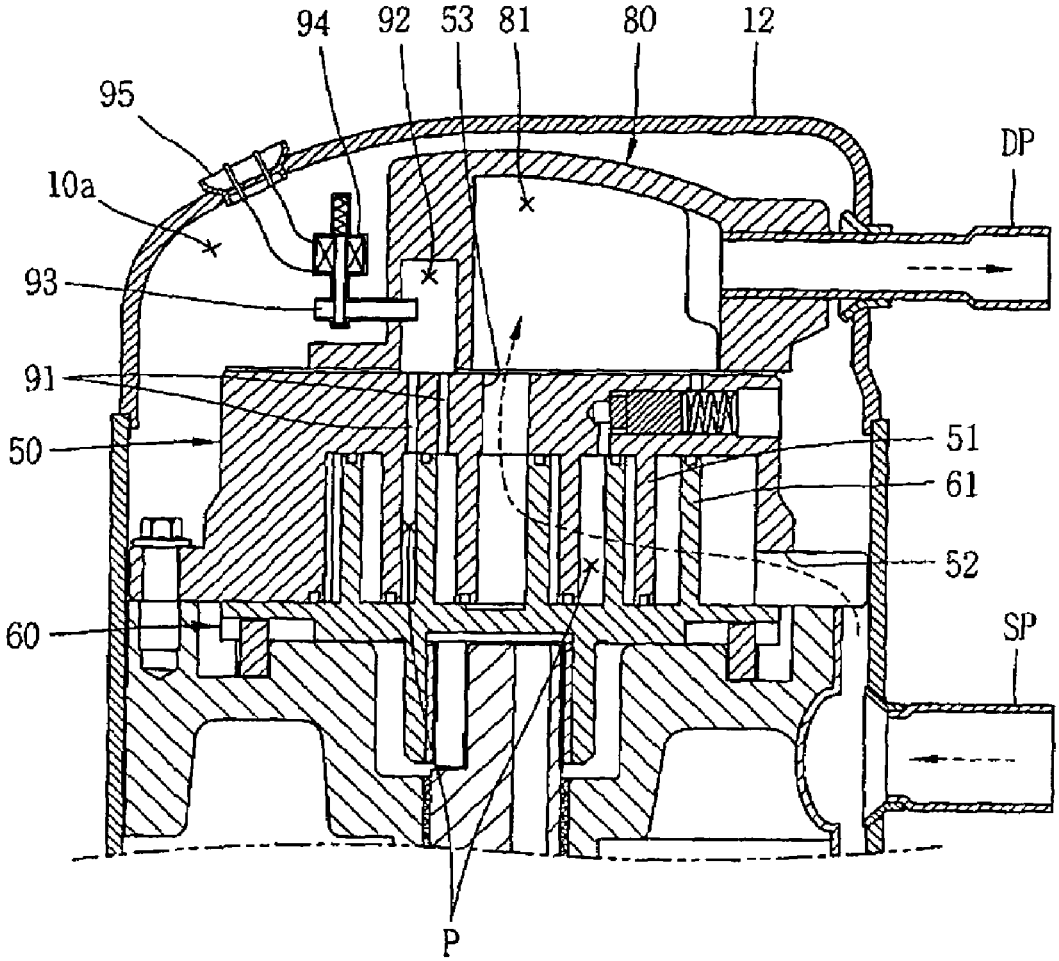
FIG. 2 is a cross section view showing a main part of the scroll compressor of FIG. 1.
Figure 3:
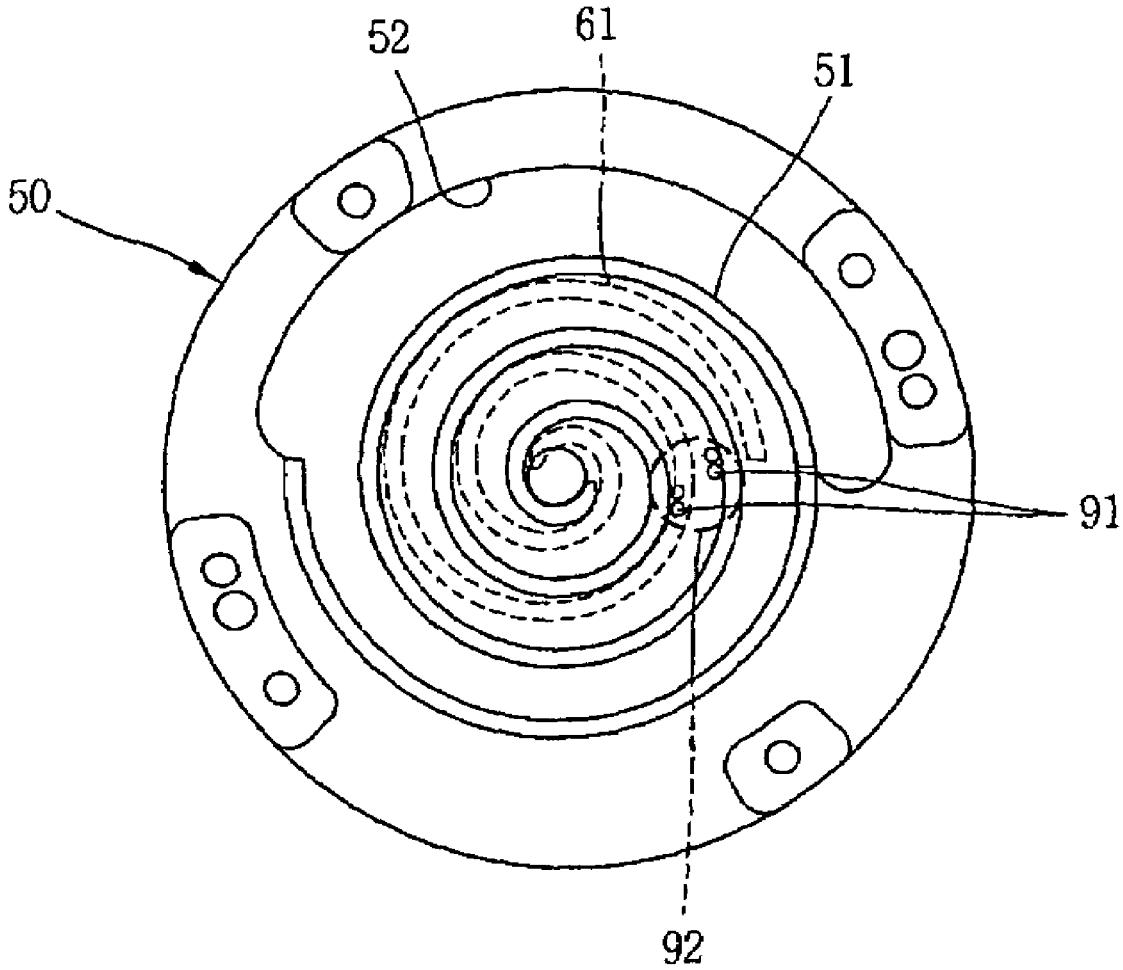
FIG. 3 is a planar view showing a non-symmetric fixed scroll of the scroll compressor of FIG. 1.

FIGS. 1 to 3 are cross section views showing one exemplary embodiment of a scroll compressor in accordance with the present invention.

As shown in FIGS. 1 and 2, the scroll compressor in accordance with the present invention includes a hermetic container 10 provided with a gas suction pipe (SP) and a gas discharge pipe (DP), a main frame 20 and a sub frame 30 respectively fixed at upper and lower portions of the hermetic container 10, a driving motor 40 mounted between the main frame 20 and the sub frame 30 so as to generate a rotational force, a fixed scroll 50 fixed over the main frame 20, an orbiting scroll 60 orbitably disposed on the main frame 20 so as to form one pair of compression chambers (P) by being engaged with the fixed scroll 50, an Oldham's ring 70 interposed between the orbiting scroll 60 and the main frame 20 so as to orbit the orbiting scroll 60 with preventing a rotation of the orbiting scroll 60, a discharge muffler 80 fixed over the fixed scroll 50 so as to remove noise of a discharged refrigerant and a bypass apparatus 90 installed at one side of the discharge muffler 80 so as to bypass a refrigerant implementing a middle pressure in the compression chambers (P).

The hermetic container 10 includes a cylindrical case 11 for installing the driving motor 40 therein, and an upper cap 12 and a lower cap 13 respectively coupled to upper and lower sides of the cylindrical case 11. The gas suction pipe (SP) is coupled to the cylindrical case 11 and also coupled to the upper cap 12 in a direction perpendicular to a length direction of the hermetic container 10. The gas discharge pipe (DP) is coupled to be communicated with a discharge space 81 of the discharge muffler 80 by passing through the upper cap 12.

As shown in FIG. 3, the fixed scroll 50 is provided with a fixed wrap 51 in a spiral shape so as to form the compression chambers at a lower surface of a plate thereof. And, a suction groove 52 is formed at an outer edge side of the fixed wrap 51 and a discharge outlet 53 is formed in the center of the fixed wrap 51. And, bypass holes 91 forming a part of the bypass apparatus 90 is formed at the plate of an intermediate portion of the fixed wrap 51, that is, in the middle side fixed wrap. The fixed wrap 51 has a wrap length to be longer than that of the orbiting wrap 61 in a circumferential direction by approximately 180° so as to simultaneously form both of the compression chambers (P). Here, if the bypass holes 91 are formed at the orbiting scroll 60, the orbiting wrap 61 of the orbiting scroll 60 may be longer than the fixed wrap 51 by approximately 180°. The bypass holes 91 may be formed to be received in a middle pressure chamber 92 on a straight line in a radial shape centering the discharge outlet 53 within a range of approximately 90° along a track of the orbiting scroll 60 so as to be respectively communicated with both of the compression chambers (P). Here, as the fixed scroll 50 and the orbiting scroll 60 are fabricated in a non-symmetric shape, that is, the fixed wrap 51 of the fixed scroll 50 is longer than the orbiting wrap 61 of the orbiting scroll 60, even if the bypass holes 91 are disposed to be adjacent to each other, it is capable of normally compressing the refrigerant with maintaining balance between the pressure of the compression chambers (P).

The orbiting wrap 61 is formed at an upper surface of the plate of the orbiting scroll 60 in the spiral shape so as to form one pair of compression chambers (P) by being engaged with the fixed wrap 51.

As shown in FIG. 2, the discharge muffler 80 has an opened lower surface, thus the discharge space 81 is formed so as to receive the discharge outlet 53 of the fixed scroll 60 therein. The middle pressure chamber 92 forming a part of the bypass apparatus 90 and serving to receive the bypass holes 91 of the fixed scroll 50 is formed at one side of the discharge space 81. And, a bypass tube 93 forming a part of the bypass apparatus 90 is inserted into one side of the middle pressure chamber 92 so as to bypass the refrigerant having been bypassed to the middle pressure chamber 92 to an inner space of the hermetic container 10, that is, a suction space 10*a*. The bypass tube 93 is coupled to the discharge muffler 80 by being sealed in a welding manner so as to prevent the refrigerant from being leaked, preferably.

As shown in FIG. 2, the bypass apparatus 90 includes the bypass holes 91, the middle pressure chamber 92, the bypass tube 93 and a bypass valve 94 fixed at the discharge muffler 80 or the fixed scroll 50 by an additional fixing member (not shown) so as to switch the bypass tube 93. The bypass valve 94 is installed to be slidable with respect to the bypass tube 93 so that a switching unit (not shown) can switch the bypass tube 93 when a power is applied. And, a power terminal 95 for applying the power to the bypass valve 94 is installed at the upper cap 12 of the hermetic container 10.

The bypass holes 91 may be implemented as a plurality of circular holes as shown in FIG. 3, as a long slit shape though it is not shown, or other shapes.

Regarding unexplained reference numerals, 41 denotes a stator, 42 denotes a rotor and 43 denotes a driving shaft.

Operations of the scroll compressor in accordance with the present invention will be explained.

When the power is applied to the driving motor 40, the driving shaft 43 orbits with the rotor 42. Then, the orbiting scroll 60 orbits on the main frame 20 by the Oldham's ring 70 by an eccentric distance, and at the same time, one pair of compression chambers (P) moving toward the center are consecutively formed between the fixed wrap 51 and the orbiting wrap 61. The compression chambers (P) are moved toward the center by the continuous orbiting motion of the orbiting scroll 60, thus the volume thereof is reduced and the refrigerant gas is sucked and compressed. And then, the refrigerant gas is discharged to a refrigeration cycle through the discharge space 81 of the discharge muffler 80 and the gas discharge pipe (DP).

Figure 4:
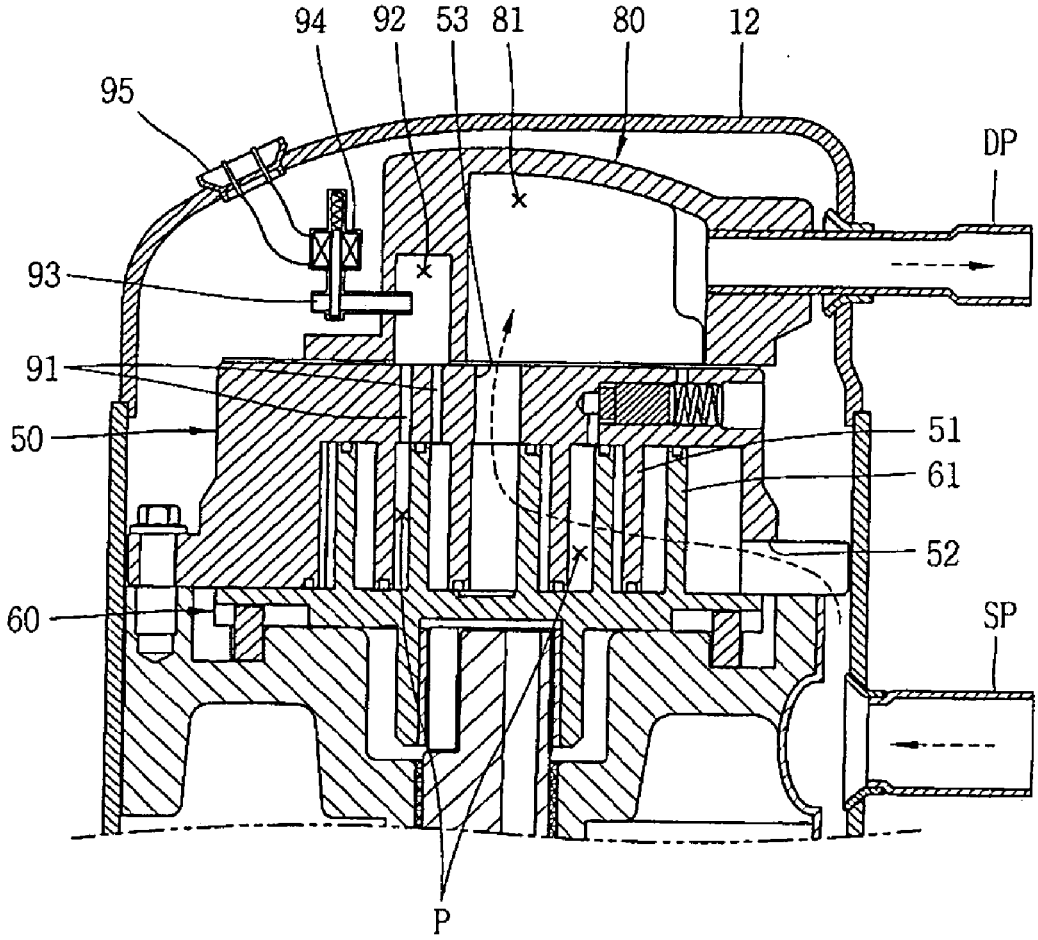
FIGS. 4 and 5 are cross section views respectively showing operations of a bypass apparatus in a power operation mode and a saving operation mode of the scroll compressor of FIG. 1.

Here, a capacity of the compressor can be varied by operating the bypass valve 94. For example, when the compressor is in a power operation mode, as shown in FIG. 4, the power is not applied to the bypass valve 94 and thus the bypass valve 94 keeps closing the bypass tube 93. Accordingly, the middle pressure chamber 92 is still filled with the middle pressure refrigerant and the middle pressure refrigerant is not bypassed into the inner space 10*a* of the hermetic container 10 implementing a suction pressure, thus the refrigerant of the compression chamber 10 is continuously moved and compressed.

Figure 5:
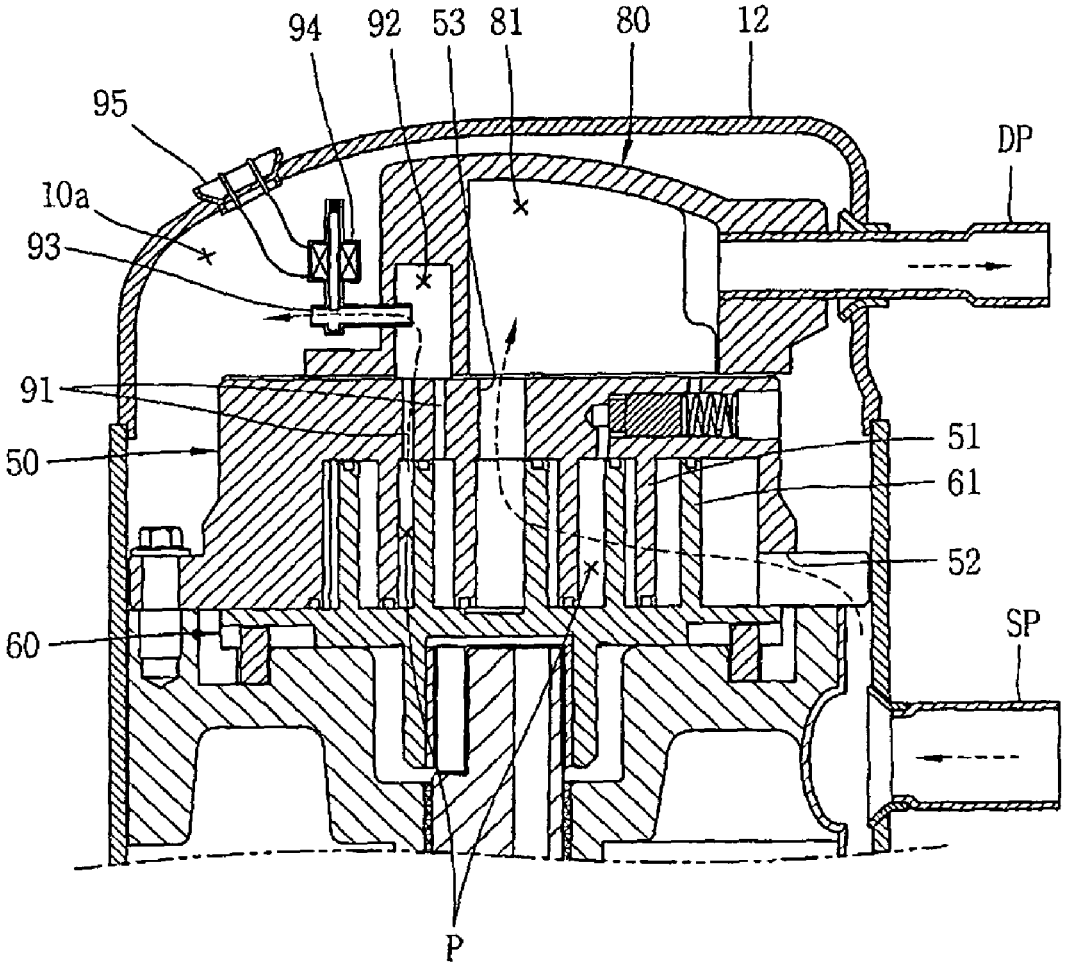

On the other hand, when the compressor is in a saving mode, as shown in FIG. 5, the power is applied to the bypass valve 94 and thus the bypass tube 93 is opened by the bypass valve 94. Accordingly, the refrigerant in the compression chambers (P) is bypassed into the inner space 10*a* of the hermetic container 10 implementing the suction pressure through the middle pressure chamber 92 and the bypass tube 93 and thus the compressor is not operated or operated in a mode requiring less capacity than that in the power mode.

As the compressor comes to have the variable capacity resulting from bypassing a part of the compressed refrigerant to one bypass valve using the bypass holes, it is capable of simplifying an apparatus for modulating the capacity of the compressor, thereby being capable of providing a capacity modulation apparatus of the scroll compressor which requires low costs and is highly reliable.

Other embodiments of the scroll compressor in accordance with the present invention will be explained.

Figure 6:
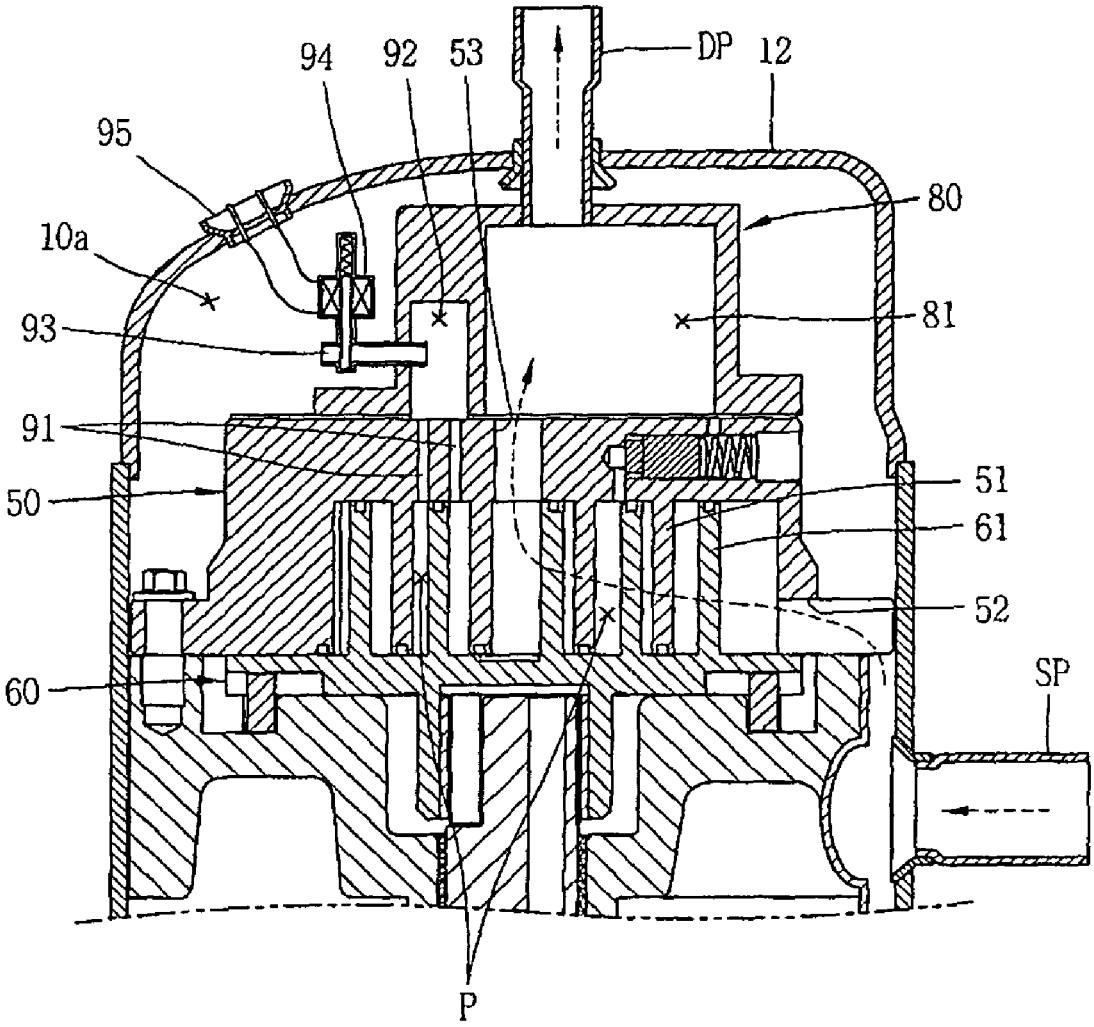
FIGS. 6 to 8 are cross section views showing other embodiments of a bypass apparatus in the scroll compressor of FIG. 1.

The gas discharge pipe (DP) is disposed in a direction perpendicular to the length direction of the hermetic container 10 of the gas discharge pipe (DP) in the first embodiment, however, as shown in FIG. 6, the gas discharge pipe (DP) is disposed in the same direction with respect to the length direction (axial direction) of the hermetic container 10 in this embodiment. Here, the positions of the bypass holes 91 and the configuration of the bypass valve 94 are same as those of the first embodiment. In this embodiment, as the gas discharge pipe (DP) is disposed in the direction same as the length direction of the hermetic container 10, the gas discharge pipe (DP) can be easily connected to the discharge muffler 80, thereby simplifying a fabrication process.

Figure 7:
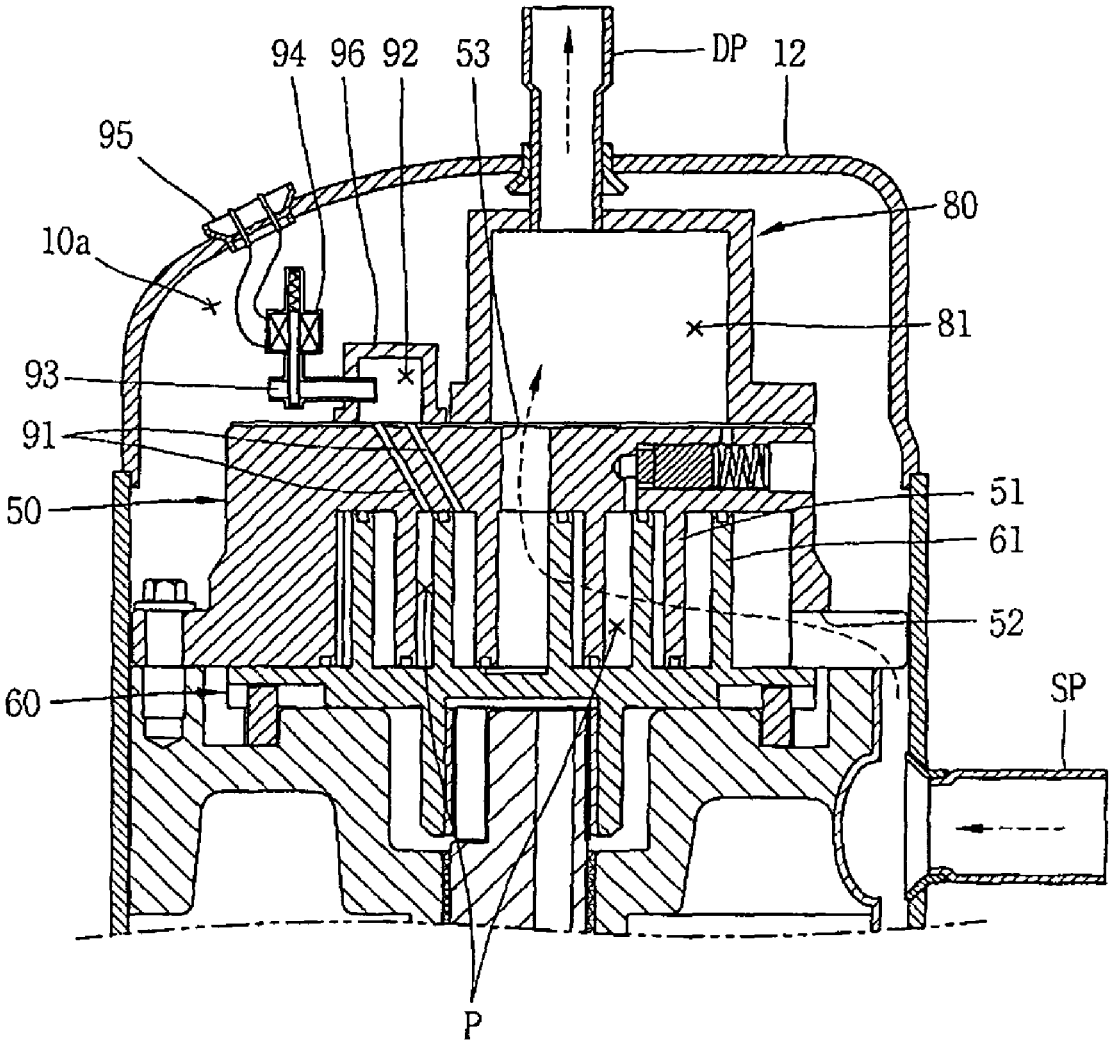

And, the middle pressure chamber 92 is formed in the discharge muffler 80 in the abovementioned embodiments, however, as shown in FIG. 7, the middle pressure chamber 92 is separated from the discharge muffler 80 in this embodiment. Here, the positions of the bypass holes 91 and the configuration of the bypass valve 94 are same as those of the first embodiment. In this embodiment, as the middle pressure chamber 92 is not formed in the discharge muffler 80 and is configured by installing an additional chamber member 96 at the fixed scroll 50, it is capable of preventing the refrigerant from being leaked between the discharge space 81 of the discharge muffler 80 and the middle pressure chamber 92.

Figure 8:
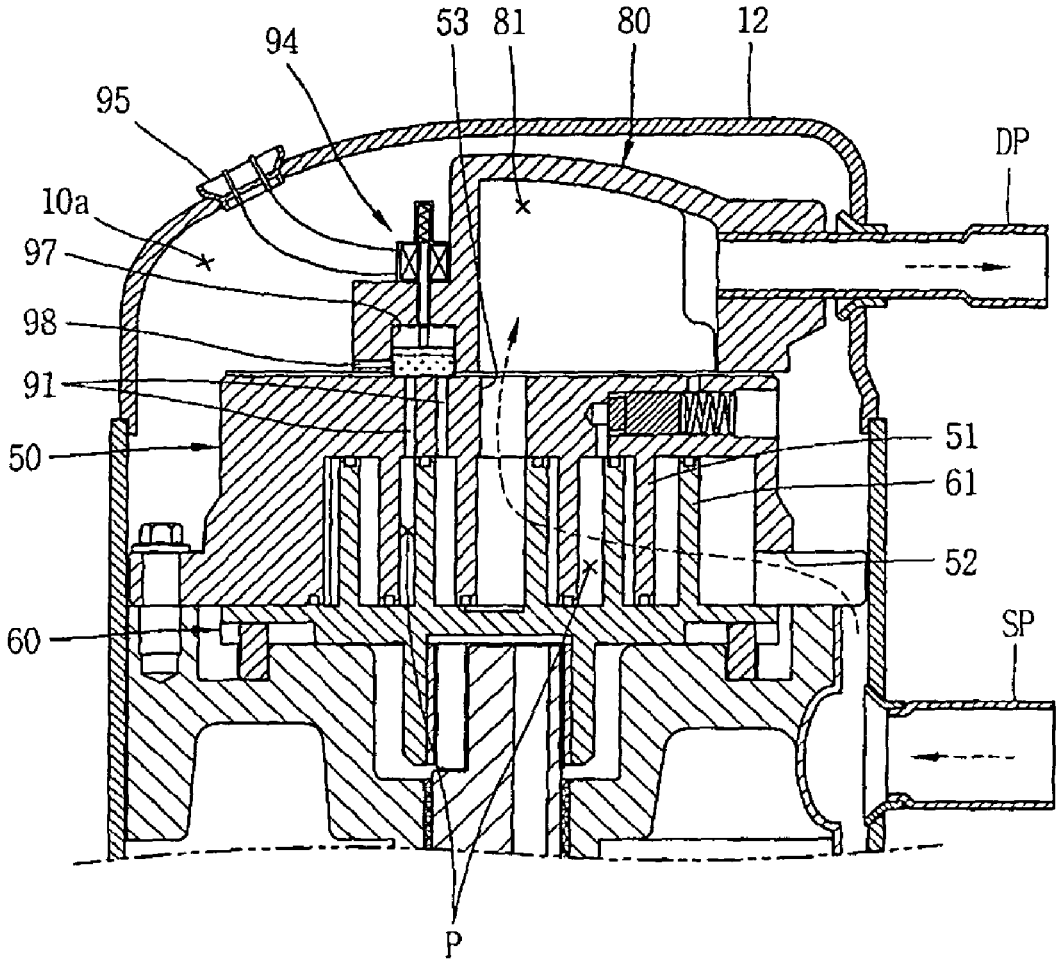

And, the refrigerant bypassed in the middle of the compression chambers (P) is collected under a state that the middle pressure chamber 92 is provided and the middle pressure chamber 92 is connected to the bypass tube 93 so as to install the bypass valve 94 at the bypass tube 93 in the abovementioned embodiments, however, as shown in FIG. 8, a valve hole 97 is formed at the discharge muffler 80 with excluding the middle pressure chamber 92 and the bypass tube 93 and the bypass valve 94 is directly coupled to be slidable into the valve hole 97 in this embodiment. Here, the positions of the bypass holes 91 are same as those of the abovementioned embodiments. In this embodiment, as the bypass holes 91 are directly opened/closed by the bypass valve 94, the discharge muffler 80 is further provided with a bypass channel 98 to be communicated with the suction pressure area of the hermetic container through the valve hole 97. Here, though it is not shown, it may be configured to directly open/close the bypass holes using an additional fixing member (not shown) without directly coupling the bypass valve 94 to the discharge muffler 80.

Figure 9:
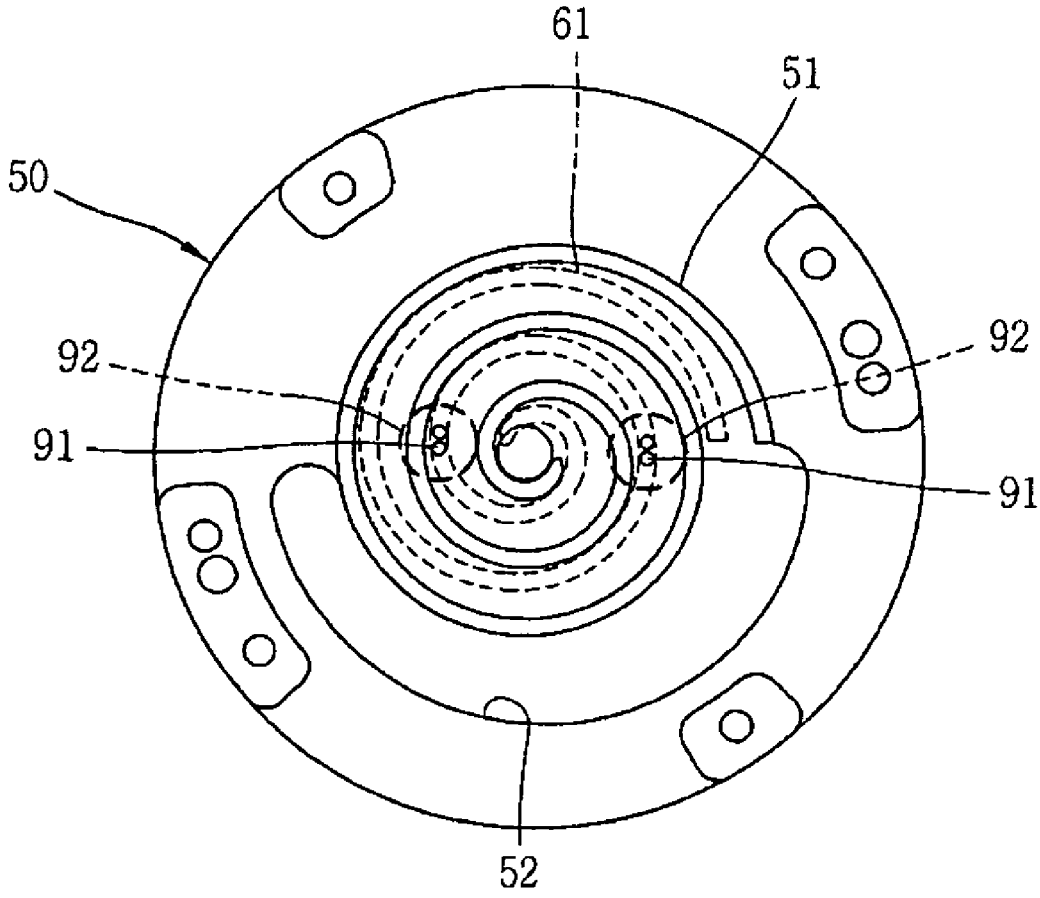
FIG. 9 is a planar view showing a symmetric fixed scroll of the scroll compressor in accordance with the present invention.

Meanwhile, the fixed wrap of the fixed scroll and the orbiting wrap of the orbiting scroll are formed in a non-symmetric shape in the abovementioned embodiments, however, the fixed wrap and the orbiting wrap can be formed to have the same wrap length to each other, i.e., in a symmetric shape. For example, as shown in FIG. 9, the fixed scroll 50 is provided with the fixed wrap 51 in the spiral shape so as to form the compression chambers at the lower surface of the plate. And, the suction groove 52 is formed at the outer edge side of the fixed wrap 51 and the discharge outlet 53 is formed at the center of the fixed wrap 51. And, the bypass holes 91 forming a part of the bypass apparatus 90 are formed at both sides of the plate at the intermediate portion of the fixed wrap 51, that is, in the middle side fixed wrap with a phase difference of approximately 180°. The length of the fixed wrap 51 and the orbiting wrap 61 may be same to each other in the circumferential direction so as to simultaneously form both of the compression chambers (P). The bypass holes 91 are separately received in the inner spaces of the plurality of middle pressure chambers 92 fixed at the upper surface of the fixed scroll 50 with the phase difference of approximately 180°. The plurality of middle pressure chambers 92 may be respectively integrated with the muffler 80 or be assembled to the muffler 80 after being separately fabricated. And, the middle pressure chambers may be implemented in one arc shape so as to receive the plurality of bypass holes therein.

Figure 10:
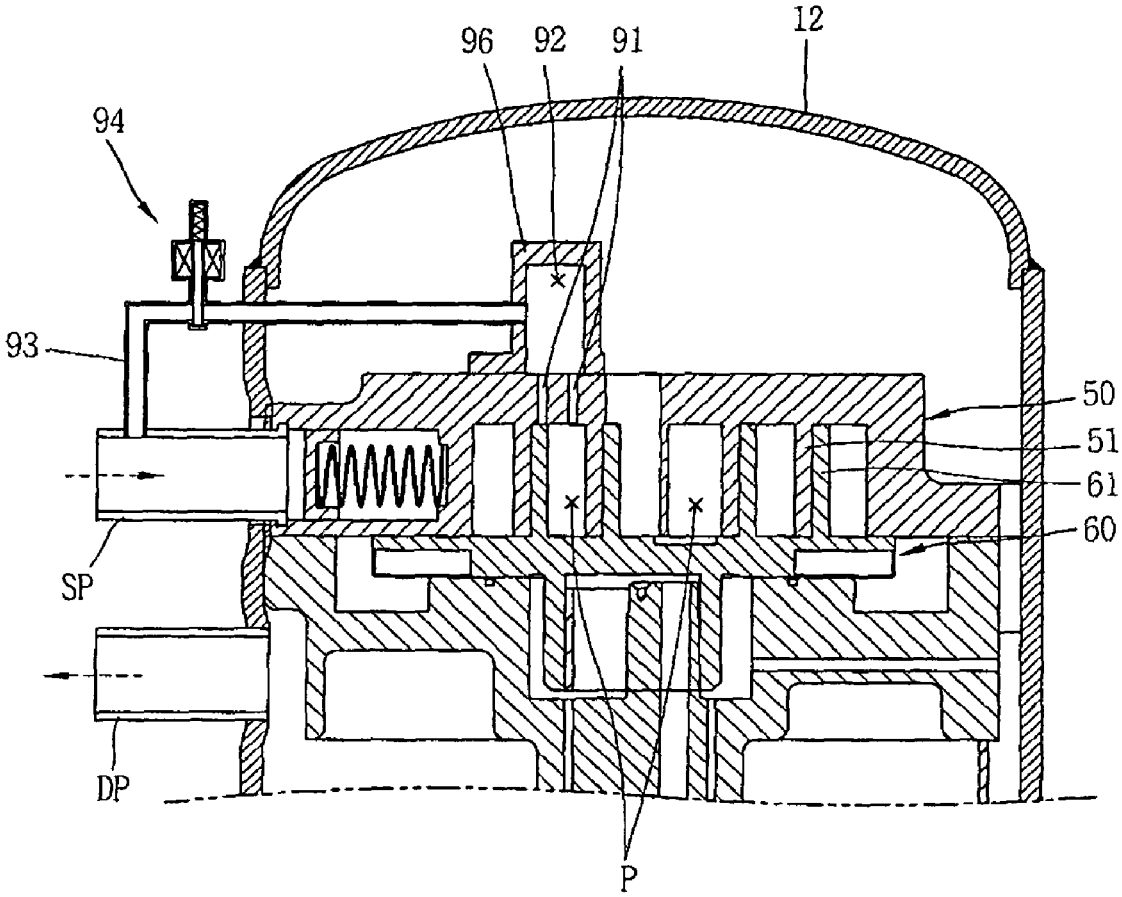
FIG. 10 is a cross section view showing one exemplary high pressure type scroll compressor in accordance with the present invention.

The abovementioned embodiments are applied to a low pressure type scroll compressor in which the inner space of the hermetic container is configured to implement the suction pressure, however, as shown in FIG. 10, can be applied to a high pressure type scroll compressor in which the inner space 10*a* of the hermetic container 10 is configured to implement a discharge pressure. Here, in the high pressure type scroll compressor, since the inner space 10*a* of the hermetic container 10 is configured to implement the discharge pressure, an electromagnet of the bypass valve 94 may be badly influenced under a high pressure atmosphere, which causes the compressor to have a degraded performance. Thus, in this case, the bypass holes may be formed at the fixed scroll and a housing 96 having the middle pressure chamber 92 receiving the bypass holes is installed. And, the bypass tube 93 communicated with the middle pressure chamber 92 of the housing 96 may be extended to the outside of the hermetic container 10 and then connected to the gas suction pipe (SP) so as to install the bypass valve 94 at the outside of the hermetic container 10. Here, the positions of the bypass holes 91 and the configuration of the middle pressure chamber 92 are same as those of the abovementioned embodiments.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A scroll compressor comprising:

a hermetic container;

a fixed scroll fixed in the hermetic container and provided with a spiral shaped fixed wrap; and an orbiting scroll provided with a spiral shaped orbiting wrap engaged with the fixed wrap of the fixed scroll so as to implement one pair of compression chambers, wherein at least one of the fixed scroll and the orbiting scroll is provided with one or more bypass holes communicated with the compression chambers, wherein at least one chamber having a specific volume is formed at an outlet side of the bypass holes, wherein a valve is installed at one side of the at the least one chamber so as to open/close an inner space of the at the least one chamber, wherein the hermetic container comprises a cylindrical case and a plurality of caps covering upper and lower sides of the case, and wherein one of the caps is provided with a power terminal for operating the valve.

2. The scroll compressor of claim 1, wherein the fixed scroll is provided with a discharge muffler for receiving a discharge outlet therein and the chamber is formed at one side surface of the discharge muffler contacting the fixed scroll.

3. A scroll compressor comprising:

a hermetic container;

a fixed scroll fixed in the hermetic container and provided with a spiral shaped fixed wrap; and an orbiting scroll provided with a spiral shaped orbiting wrap engaged with the fixed wrap of the fixed scroll so as to implement one pair of compression chambers, wherein at least one of the fixed scroll and the orbiting scroll is provided with one or more bypass holes communicated with the compression chambers, wherein at least one chamber having a specific volume is formed at an outlet side of the bypass holes, wherein a valve is installed at one side of the at the least one chamber so as to open/close an inner space of the at the least one chamber, wherein a suction side of the compression chambers is communicated with a gas suction pipe, the inner space of the hermetic container is communicated with the discharge pipe and the chamber is selectively communicated with the gas suction pipe by the valve.

4. The scroll compressor of claim 3, wherein the fixed scroll is provided with a discharge muffler for receiving a discharge outlet therein and the chamber is formed at one side surface of the discharge muffler contacting the fixed scroll.

* * * * *